US009453689B2

(12) United States Patent
Dai et al.

(10) Patent No.: US 9,453,689 B2
(45) Date of Patent: Sep. 27, 2016

(54) FLAT HEAT PIPE

(71) Applicants: FURUI PRECISE COMPONENT (KUNSHAN) CO., LTD., Kunshan (CN); Foxconn Technology Co., Ltd., New Taipei (TW)

(72) Inventors: Sheng-Liang Dai, Kunshan (CN); Jin-Peng Liu, Kunshan (CN); Yue Liu, Kunshan (CN); Sheng-Guo Zhou, Kunshan (CN); Sheng-Lin Wu, New Taipei (TW); Nien-Tien Cheng, New Taipei (TW)

(73) Assignees: FURUI PRECISE COMPONENT (KUNSHAN) CO., LTD., Kunshan (CN); Foxconn Technology Co., Ltd., New Taipei (TW)

( * ) Notice: Subject to any disclaimer, the term of this patent is extended or adjusted under 35 U.S.C. 154(b) by 348 days.

(21) Appl. No.: 14/140,573

(22) Filed: Dec. 26, 2013

(65) Prior Publication Data

US 2014/0102671 A1 Apr. 17, 2014

Related U.S. Application Data

(62) Division of application No. 12/824,504, filed on Jun. 28, 2010, now Pat. No. 8,667,684.

(30) Foreign Application Priority Data

May 14, 2010 (CN) ..... 2010 1 0172515

(51) Int. Cl.
*F28D 15/04* (2006.01)

(52) U.S. Cl.
CPC ..... *F28D 15/04* (2013.01); *F28D 15/046* (2013.01); *Y10T 29/49353* (2015.01)

(58) Field of Classification Search
CPC ..... Y10T 29/49353; F28D 15/04; F28D 15/046; H01L 23/427; B23P 15/26
USPC ..... 165/104.26
See application file for complete search history.

(56) References Cited

U.S. PATENT DOCUMENTS

2006/0174484 A1* 8/2006 Chuang ..... B23P 15/26 29/890.032
2010/0266864 A1* 10/2010 Lee ..... B22F 7/08 428/557
2016/0033206 A1* 2/2016 Kameoka ..... F28D 15/0233 165/104.26

FOREIGN PATENT DOCUMENTS

JP 61052587 A * 3/1986
JP 2000-74578 A 3/2000

(Continued)

OTHER PUBLICATIONS

Translation of JP200074578-A.*

(Continued)

*Primary Examiner* — Jacob Cigna
(74) *Attorney, Agent, or Firm* — Zhigang Ma

(57) ABSTRACT

An exemplary flat heat pipe includes a hollow, flattened casing and a first wick structure and a second wick structure received in the casing. The casing includes a top plate and a bottom plate opposite to the top plate. The first wick structure is formed by weaving wires, and the second wick structure is made of sintered metal powder. The first and second wick structures are disposed at inner sides of the bottom and top plates of the casing, respectively. The first and second wick structures contact each other. The casing defines two vapor channels at opposite lateral sides of the combined first and second wick structures, respectively.

11 Claims, 15 Drawing Sheets

(56) References Cited

FOREIGN PATENT DOCUMENTS

| | | | | | |
|---|---|---|---|---|---|
| JP | 2000074578 | A | * | 3/2000 | |
| JP | 2009-68787 | A | | 4/2009 | |
| JP | WO 2011010395 | A1 | * | 1/2011 | ..... F28D 15/0233 |
| TW | I289654 | B | | 11/2007 | |
| TW | 200923307 | A | | 6/2009 | |

OTHER PUBLICATIONS

Merriam Webster Dictionary Definition of "Oblique" ret. May 18, 2016.*

* cited by examiner

FLAT HEAT PIPE

CROSS-REFERENCE TO RELATED APPLICATION

This patent application is a divisional application of patent application Ser. No. 12/824,504, filed on Jun. 28, 2010, entitled "FLAT HEAT PIPE AND METHOD FOR MANUFACTURING THE SAME", which is assigned to the same assignee as the present application, and which is based on and claims priority from Chinese Patent Application No. 201010172515.1 filed in China on May 14, 2010. The disclosures of patent application Ser. No. 12/824,504 and the Chinese Patent Application No. 201010172515.1 are incorporated herein by reference in their entirety.

BACKGROUND

1. Technical Field

The disclosure generally relates to heat transfer apparatuses, and particularly to a flat heat pipe with high heat transfer performance.

2. Description of Related Art

Heat pipes are widely used in various fields for heat dissipation purposes due to their excellent heat transfer performance. One commonly used heat pipe includes a sealed tube made of heat conductive material, with a working fluid contained therein. The working fluid conveys heat from one end of the tube, typically referred to as an evaporator section, to the other end of the tube, typically referred to as a condenser section. Preferably, a wick structure is provided inside the heat pipe, lining an inner wall of the tube, and drawing the working fluid back to the evaporator section after it condenses at the condenser section.

During operation, the evaporator section of the heat pipe maintains thermal contact with a heat-generating electronic component. The working fluid at the evaporator section absorbs heat generated by the electronic component, and thereby turns to vapor. Due to the difference in vapor pressure between the two sections of the heat pipe, the generated vapor moves, carrying the heat with it, toward the condenser section. At the condenser section, the vapor condenses after transferring the heat to, for example, fins thermally contacting the condenser section. The fins then release the heat into the ambient environment. Due to the difference in capillary pressure which develops in the wick structure between the two sections, the condensate is then drawn back by the wick structure to the evaporator section where it is again available for evaporation.

Wick structures currently available for heat pipes can be fine grooves defined in the inner surface of the tube, screen mesh or fiber inserted into the tube and held against the inner surface of the tube, or sintered powder bonded to the inner surface of the tube by a sintering process. The grooved, screen mesh and fiber wick structures provide a high capillary permeability and a low flow resistance for the working medium, but have a small capillary force to drive condensed working medium from the condenser section toward the evaporator section of the heat pipe. In addition, a maximum heat transfer rate of these wick structures drops significantly after the heat pipe is flattened. The sintered wick structure provides a high capillary force to drive the condensed working medium, and the maximum heat transfer rate does not drop significantly after the heat pipe is flattened. However, the sintered wick structure provides only a low capillary permeability, and has a high flow resistance for the working medium.

What is needed, therefore, is a flat heat pipe which has a high heat transfer performance overall.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views, and all the views are schematic.

DETAILED DESCRIPTION

Figure 1:
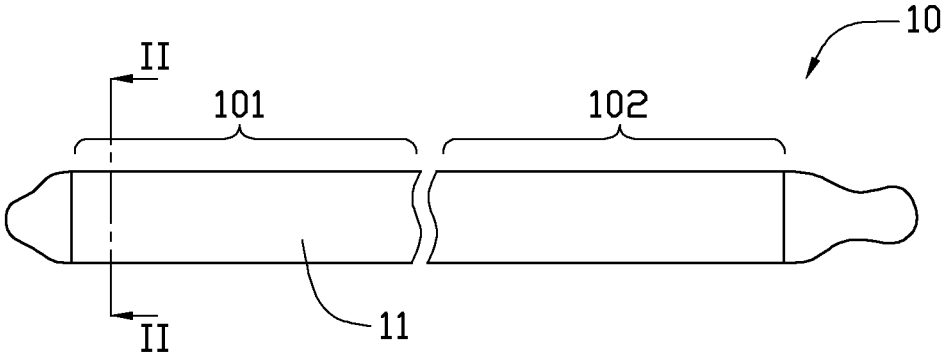
FIG. 1 is an abbreviated, lateral side plan view of a heat pipe in accordance with a first embodiment of the disclosure.
Figure 2:
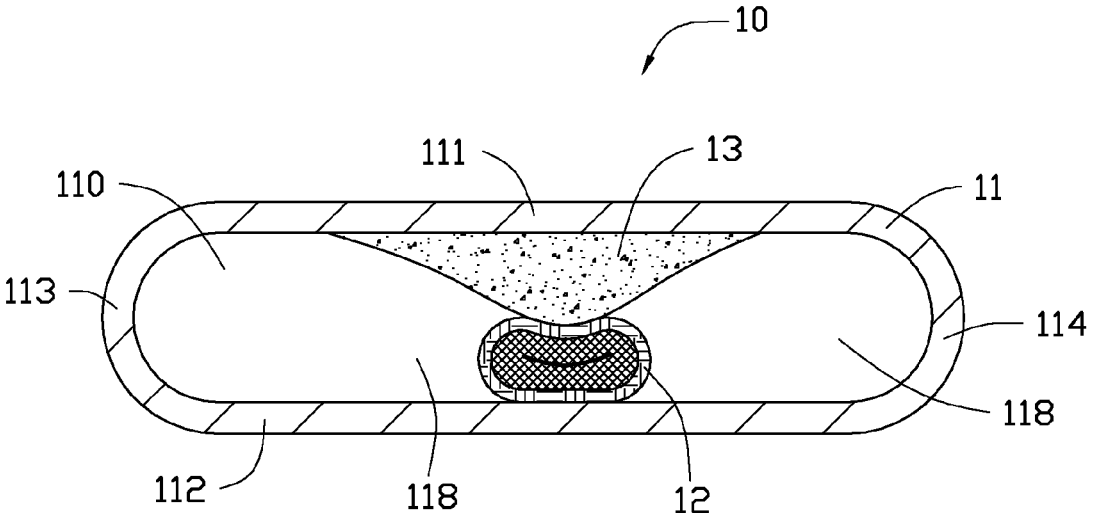
FIG. 2 is an enlarged, transverse cross section of the heat pipe of FIG. 1, taken along line II-II thereof.

Referring to FIGS. 1-2, a heat pipe 10 in accordance with a first embodiment of the disclosure is shown. The heat pipe 10 is a flat heat pipe, and includes a flat tube-like casing 11 with two ends thereof sealed, and a variety of elements enclosed in the casing 11. Such elements include a first wick structure 12, a second wick structure 13, and a working medium (not shown). The heat pipe 10 has an evaporator section 101 and an opposite condenser section 102 located end-to-end along a longitudinal direction thereof.

The casing 11 is made of metal or metal alloy with a high heat conductivity coefficient, such as copper, copper-alloy, or other suitable material. The casing 11 has a width larger than its height. In particular, the casing 11 has a flattened transverse cross section. To meet the height requirements of common electronic products, the height of the casing 11 is preferably less than or equal to 2 millimeters (mm). The casing 11 is hollow, and longitudinally defines an inner space 110 therein. The casing 11 includes a top plate 111, a bottom plate 112 opposite to the top plate 111, and two side plates 113, 114 interconnecting the top and bottom plates 111, 112. The top and bottom plates 111, 112 are flat and parallel to each other. The side plates 113, 114 are arcuate and respectively disposed at opposite lateral sides of the casing 11.

The first wick structure 12 is elongated, and extends longitudinally through the evaporator section 101 and the condenser section 102. The first wick structure 12 is flattened to form a generally flat, solid structure. The first wick structure 12 is a multilayer-type structure, which is layered along a radial direction thereof by weaving a plurality of metal wires such as copper or stainless steel wires. The first wick structure 12 thus has a plurality of pores therein. The first wick structure 12 provides a large capillary permeability and a low flow resistance to the working medium, thereby promoting the flow of the working medium in the heat pipe 10. Alternatively, the first wick structure 12 can be a monolayer-type structure formed by weaving a plurality of metal wires.

The first wick structure 12 is disposed at a middle of one inner side of the casing 11, with a bottom surface of the first wick structure 12 snugly attached to an inner surface of the bottom plate 112 of the casing 11, and a top surface of the first wick structure 12 snugly in contact with the second wick structure 13.

The second wick structure 13 is made of sintered metal powder such as copper powder. The second wick structure 13 provides a large capillary force to drive condensed working medium at the condenser section 102 to flow toward the evaporator section 101 of the heat pipe 10. In particular, a maximum heat transfer rate ($Q_{max}$) of the second wick structure 13 does not significantly drop after the heat pipe 10 is flattened. The second wick structure 13 is disposed at a middle of another inner side of the casing 11 opposite to the first wick structure 12. In other words, the second wick structure 13 directly faces (aligns with) the first wick structure 11. The second wick structure 13 tapers from a top surface thereof farthest away from the first wick structure 12 toward a bottom lateral side thereof in contact with the first wick structure 12. In this embodiment, the second wick structure 13 has a substantially triangular prism shape. The top surface of the second wick structure 13 is snugly attached to an inner surface of the top plate 111 of the casing 11 by sintering, and the bottom lateral side of the second wick structure 13 forms a rounded ridge attached to a middle of the top surface of the first wick structure 12.

The first and second wick structures 12, 13 are stacked together in a height direction of the casing 11, and divide the inner space 110 of the casing 11 into two longitudinal vapor channels 118. The vapor channels 118 are disposed at opposite lateral sides of the combined first and second wick structures 12, 13, respectively, and provide passages through which the vapor flows from the evaporator section 101 to the condenser section 102.

The working medium is injected into the casing 11 and saturates the first and second wick structures 12, 13. The working medium usually selected is a liquid such as water, methanol, or alcohol, which has a low boiling point. The casing 11 of the heat pipe 10 is evacuated and hermetically sealed after injection of the working medium. The working medium can evaporate when it receives heat at the evaporator section 101 of the heat pipe 10.

In operation, the evaporator section 101 of the heat pipe 10 is placed in thermal contact with a heat source (not shown) that needs to be cooled. The heat source can, for example, be a central processing unit (CPU) of a computer. The working medium contained in the evaporator section 101 of the heat pipe 10 vaporizes when it reaches a certain temperature while absorbing heat generated by the heat source. The generated vapor moves from the evaporator section 101 via the vapor channels 118 to the condenser section 102. After the vapor releases its heat and condenses in the condenser section 102, the condensed working medium is returned via the first and second wick structures 12, 13 to the evaporator section 101 of the heat pipe 10, where the working medium is again available to absorb heat.

In the heat pipe 10, the first wick structure 12 is formed by weaving a plurality of wires, and is disposed at one inner side (i.e., the inner surface of the bottom plate 112) of the casing 11. The second wick structure 13 is made of sintered metal powder, and is disposed at another opposite inner side (i.e., the inner surface of the top plate 111) of the casing 11. The first and second wick structures 12, 13 contact each other. Therefore, during operation of the heat pipe 10, the working medium can be freely exchanged between the first and second wick structures 12, 13. Thus, the heat pipe 10 has not only a high capillary permeability and a low flow resistance due to the first wick structure 12 being formed by weaving a plurality of wires, but also a large capillary force due to the second wick structure 13 being made of sintered power. Thereby, a heat transfer performance of the heat pipe 10 is improved.

Table 1 below shows an average of maximum heat transfer rates (Qmax) and an average of heat resistances (Rth) of thirty conventional grooved heat pipes, thirty conventional sintered heat pipes and thirty heat pipes 10 in accordance with the present disclosure, all of which have a height of 2 mm. Table 2 below shows an average of Qmax and an average of Rth of thirty conventional grooved heat pipes, thirty conventional sintered heat pipes and thirty heat pipes 10 in accordance with the present disclosure, all of which have a height of 1.8 mm. Qmax represents the maximum heat transfer rate of each heat pipe at an operational temperature of 50° C. Rth is obtained by dividing the difference between an average temperature of the evaporator section of the heat pipe and an average temperature of the condenser section of the heat pipe by Qmax. A diameter of the transverse cross section (i.e. a width) and a longitudinal length of each of the conventional grooved and sintered heat pipes are 6 mm and 200 mm, respectively, which are equal to the diameter of the transverse cross section (i.e. the width) and the longitudinal length of each of the heat pipes 10, respectively. Tables 1 and 2 show that the average of Rth of the heat pipes 10 is significantly less than that of the conventional grooved and sintered heat pipes, and that the average of Qmax of the heat pipe 10 is significantly more than that of the conventional grooved and sintered heat pipes.

TABLE 1

| Types of heat pipes | average of Qmax (unit: W) | average of Rth (unit: ° C./W) |
|---|---|---|
| Conventional grooved heat pipes | 19.1 | 0.261 |
| Conventional sintered heat pipes | 23.6 | 0.212 |
| Heat pipes 10 | 30.0 | 0.166 |

TABLE 2

| Types of heat pipes | average of Qmax (unit: W) | average of Rth (unit: ° C./W) |
|---|---|---|
| Conventional grooved heat pipes | 15.9 | 0.314 |
| Conventional sintered heat pipes | 19.5 | 0.256 |
| Heat pipes 10 | 25.0 | 0.200 |

Figure 3:
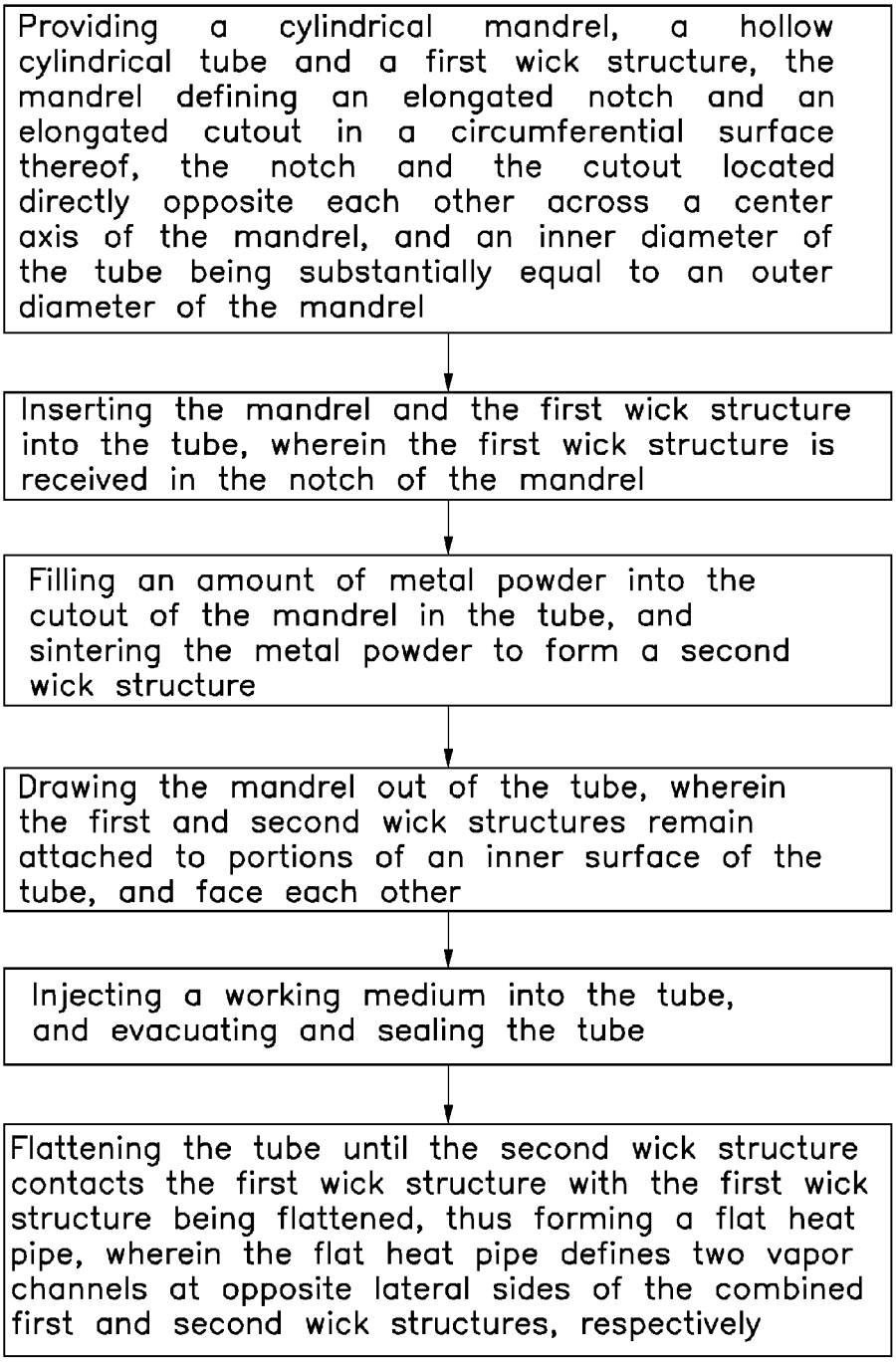
FIG. 3 is a flowchart showing an exemplary method for manufacturing the heat pipe of FIG. 1.
Figure 4:
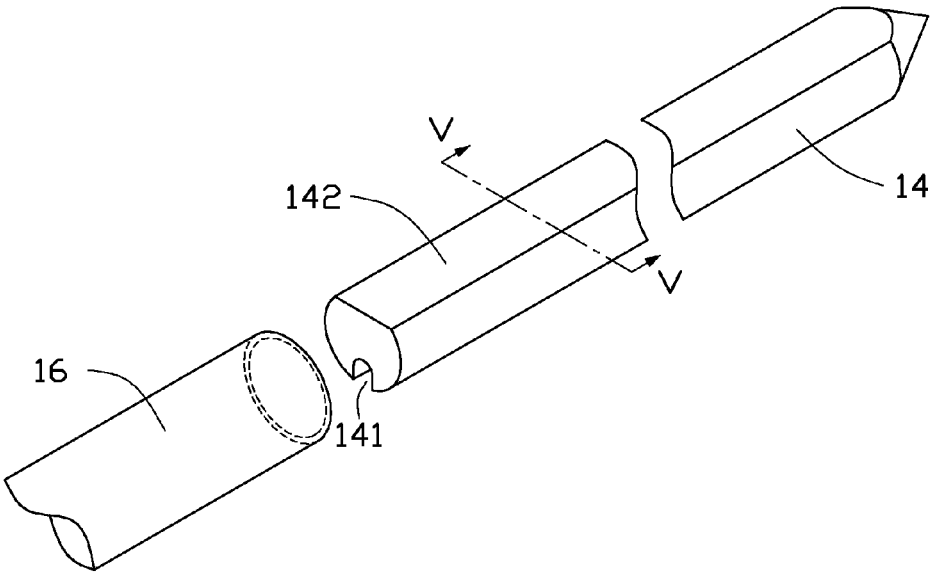
FIG. 4 is an abbreviated, exploded, isometric view of a cylindrical tube and a cylindrical mandrel used for manufacturing the heat pipe according to the method of FIG. 3.
Figure 5:
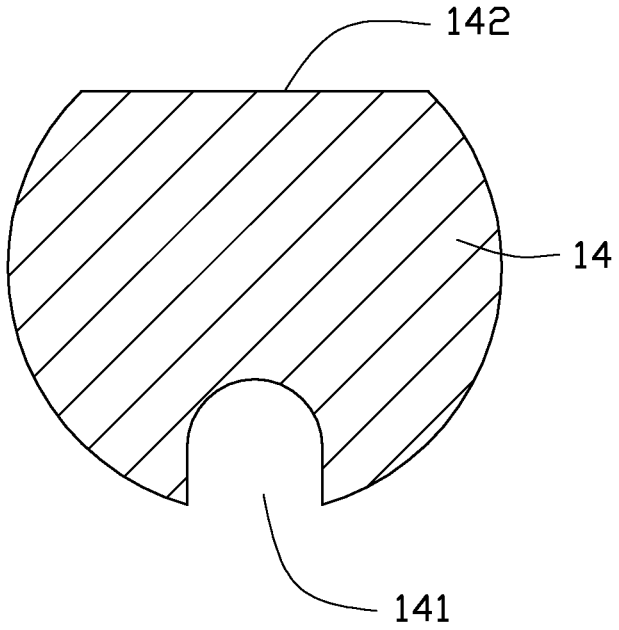
FIG. 5 is an enlarged, transverse cross section of the cylindrical mandrel of FIG. 4, taken along line V-V thereof.
Figure 6:
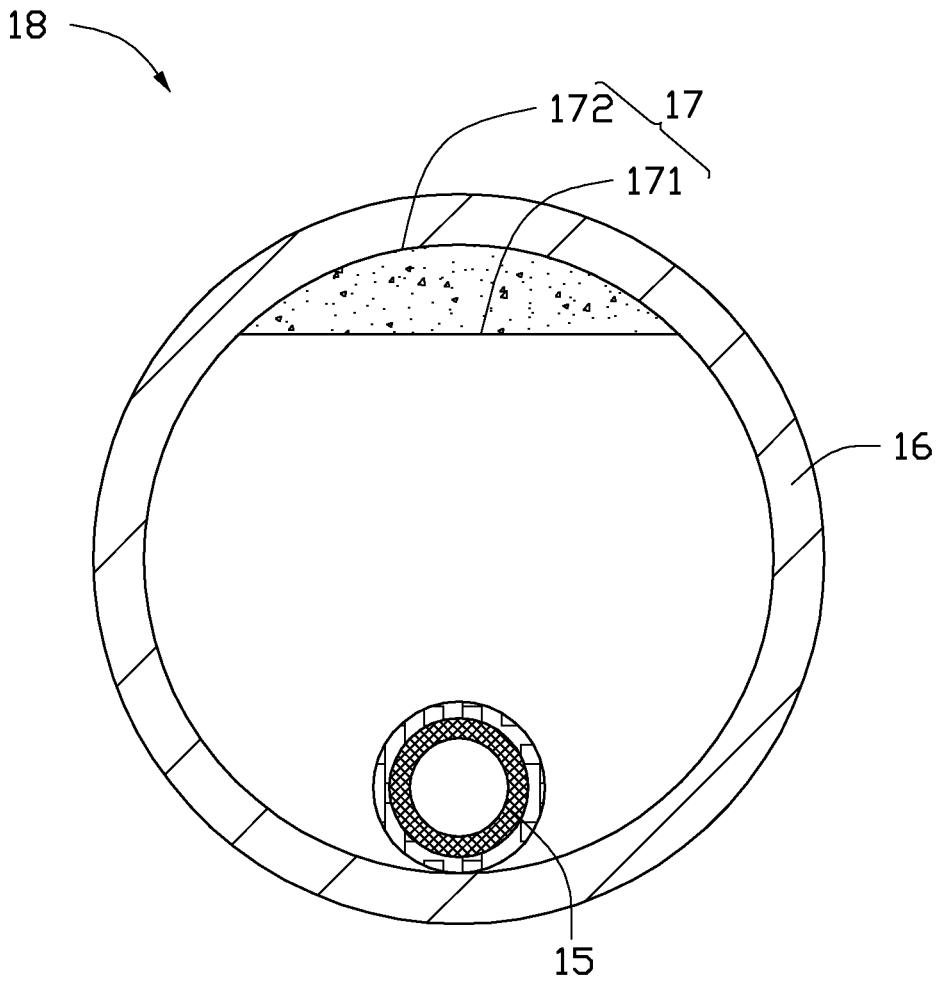
FIG. 6 is a transverse cross section of a semi-finished heat pipe manufactured according to the method of FIG. 3, showing a semi-finished first wick structure and a semi-finished second wick structure received in the cylindrical tube of FIG. 4.

FIG. 3 summarizes an exemplary method for manufacturing the heat pipe 10. The method includes the following steps:

Referring also to FIGS. 4-6, firstly, a mandrel 14, a first wick structure preform 15 and a tube 16 are provided. The mandrel 14 is elongated and generally cylindrical, and longitudinally defines a notch 141 in a circumferential surface thereof. The notch 141 is located at a bottom side of the mandrel 14, and spans through both a front end surface and a rear end surface of the mandrel 14. A transverse cross section defined by the notch 141 is arch-shaped. A longitudinal wall portion of the mandrel 14 is horizontally cut, thereby defining a cutout 142 in a circumferential surface of the mandrel 14. The cutout 142 is located at a top side of the mandrel 14. An inmost extremity of the cutout 142 is planar, corresponding to a planar face of the mandrel 14 which borders the cutout 142. A central longitudinal axis (not shown) of the cutout 142 is aligned directly over a central longitudinal axis (not shown) of the notch 141. The cutout 142 does not communicate with the notch 141. The tube 16 is hollow and cylindrical, and is made of highly heat conductive metal, such as copper, etc. An inner diameter of the tube 16 is substantially equal to an outer diameter of the mandrel 14. The first wick structure preform 15 is hollow and cylindrical, and has an annular cross section. The first wick structure preform 15 has an outer diameter substantially equal to an inner diameter of the notch 141 of the mandrel 14.

The first wick structure preform 15 is horizontally inserted into the notch 141 of the mandrel 14. Then the mandrel 14 with the first wick structure preform 15 is inserted into the tube 16. An amount of metal powder is filled into the cutout 142 of the mandrel 14 in the tube 16. The tube 16 is vibrated until the metal powder is evenly distributed along the length of the tube 16 in accordance with its particle size. In particular, smaller particles of the metal powder migrate to a lower end of the tube 16, and larger particles of the metal powder migrate to an upper end of the tube 16. The tube 16 with the mandrel 14, the metal powder and the first wick structure preform 15 is heated at high temperature until the metal powder sinters to form a second wick structure preform 17. A transverse cross section of the second wick structure preform 17 is the shape of a segment on a chord. In particular, the transverse cross section includes a straight line 171 and an arcuate line 172 connecting the straight line 171. The arcuate line 172 represents the part of the second wick structure preform 17 which is attached to the inner surface of the tube 16.

Referring to FIG. 6, the mandrel 14 is then drawn out of the tube 16, with the first and second wick structure preforms 15, 17 being retained in the tube 16. The first and second wick structure preforms 15, 17 face each other, and each is attached to a corresponding portion of the inner surface of the tube 16. Subsequent processes such as injecting a working medium into the tube 16, and evacuating and sealing the tube 16, can be performed using conventional methods. Thereby, a straight circular heat pipe 18 is attained. Finally, the circular heat pipe 18 is flattened, with the first and second wick structure preforms 15, 17 moving directly toward each other until the first wick structure preform 15 deforms into a solid structure under the pressure of the second wick structure preform 17. Thus, the flat heat pipe 10 as illustrated in FIGS. 1 and 2 is formed. That is, the flattened tube 16 forms the casing 11, the flattened second wick structure preform 17 forms the tapered second wick structure 13, and the first wick structure preform 15 is press formed by the second wick structure 13 to obtain the solid, flattened first wick structure 12.

Advantages of the method include the following. The cutout 142 of the mandrel 14 has a planar inmost extremity. Thus, the cutout 142 can be easily formed by directly milling the mandrel 14 using a milling machine (not shown). This reduces the cost of manufacturing the heat pipe 10.

Figure 7:
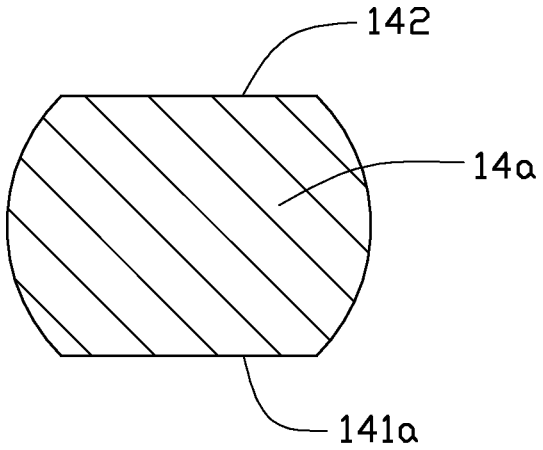
FIG. 7 is similar to FIG. 5, but shows a transverse cross section of a cylindrical mandrel used for manufacturing the heat pipe of FIG. 1 according to another exemplary method.
Figure 8:
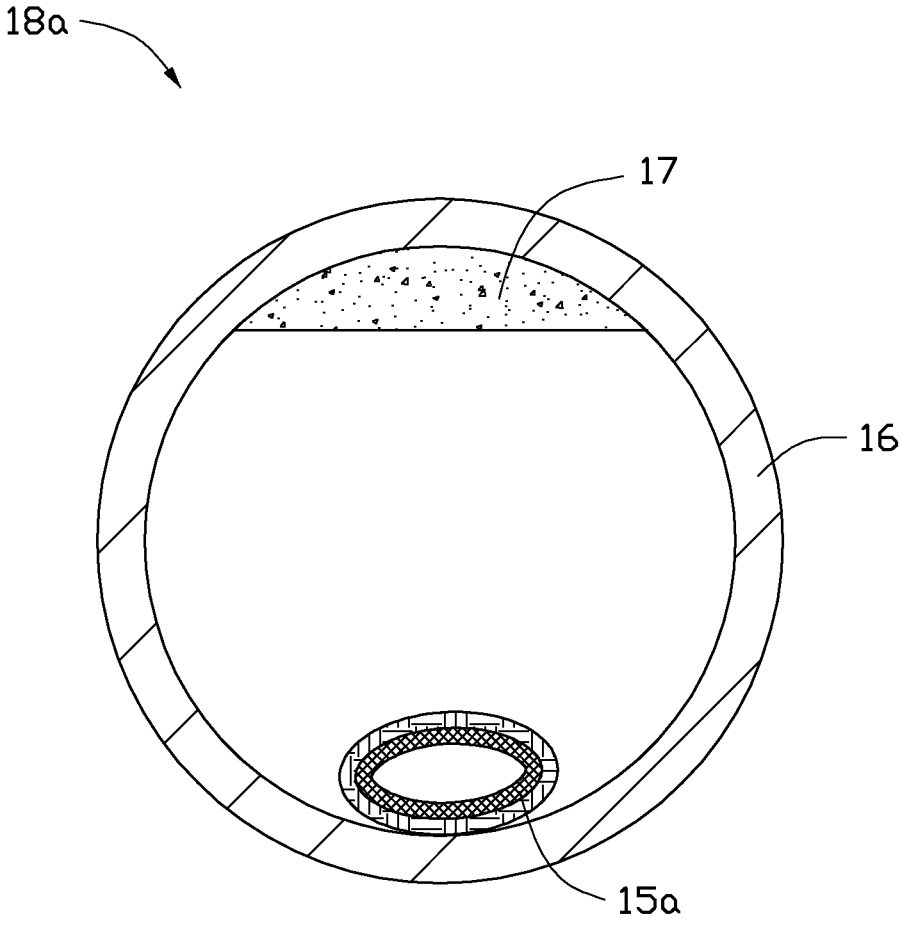
FIG. 8 is similar to FIG. 6, but shows a transverse cross section of a semi-finished heat pipe manufactured according to the method of FIG. 7.

Referring to FIGS. 7 and 8, aspects of another exemplary method for manufacturing the heat pipe 10 are illustrated. This method differs from the method summarized and illustrated in FIGS. 3 to 6 only in that a notch 141*a* of a mandrel 14*a* has a planar inmost extremity, similar to the planar inmost extremity of the cutout 142. A first wick structure preform 15*a* is hollow and cylindrical, and has an elliptic cross section. The mandrel 14*a* is inserted into the tube 16, and the first wick structure preform 15*a* is inserted into the notch 141*a* of the mandrel 14*a* within the tube 16. After that, a straight circular heat pipe 18*a* is formed. Since the notch 141*a* of the mandrel 14*a* provided in this method is planar, the notch 141*a* can be also easily formed via directly milling the mandrel 14 using a milling machine. Thus, the cost of manufacturing the heat pipe 10 is further reduced.

Figure 9:
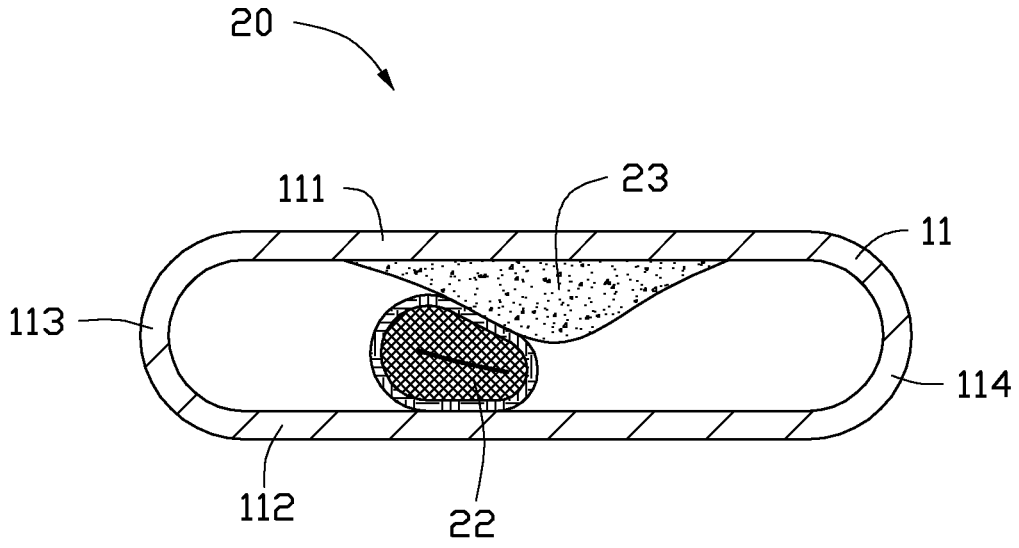
FIG. 9 is similar to FIG. 2, but shows a transverse cross section of a heat pipe according to a second embodiment of the disclosure.

Referring to FIG. 9, a heat pipe 20 in accordance with a second embodiment of the disclosure is shown. The heat pipe 20 differs from the heat pipe 10 of the first embodiment only in that the first wick structure 22 obliquely faces the second wick structure 23. The first wick structure 22 is disposed in a middle of the casing 11, but closer to the left side plate 113 of the casing 11 than the right side plate 114 of the casing 11. A left side surface of the second wick structure 23 not in contact with the top plate 111 of the casing 11 is snugly attached to a right lateral side of the top surface of the first wick structure 22. Alternatively, the first wick structure 22 can be disposed in the middle of the casing 11 but closer to the right side plate 114 of the casing than the left side plate 113 of the casing 11. In such case, a right side surface of the second wick structure 23 not in contact with the top plate 111 of the casing 11 is snugly attached to a left lateral side of the top surface of the first wick structure 22.

During manufacture of the heat pipe 20, the first wick structure preform 15 obliquely faces the second wick structure preform 17, in a manner similar to that illustrated in FIGS. 6, 8. Then the circular heat pipe 18 is flattened. Alternatively, the first wick structure preform 15*a* obliquely faces the second wick structure preform 17, in a manner similar to that illustrated in FIGS. 6, 8. Then the circular heat pipe 18*a* is flattened.

Figure 10:
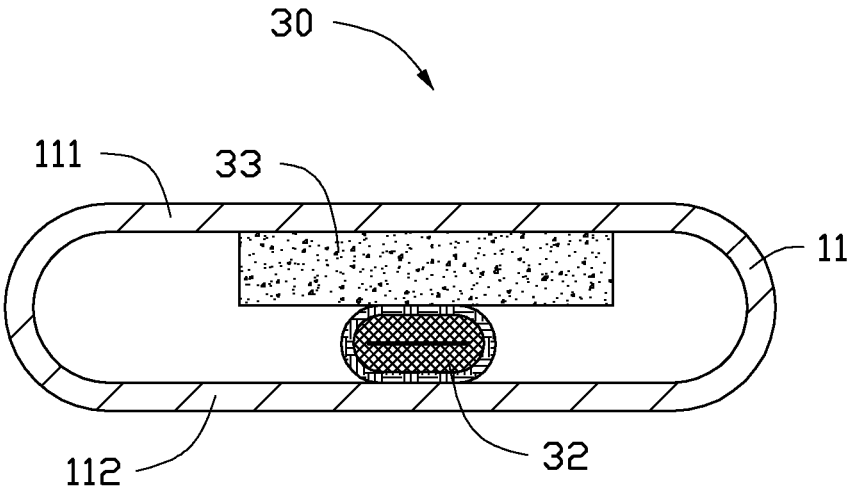
FIG. 10 is similar to FIG. 2, but shows a transverse cross section of a heat pipe according to a third embodiment of the disclosure.

Referring to FIG. 10, a heat pipe 30 in accordance with a third embodiment of the disclosure is shown. The heat pipe 30 differs from the heat pipe 10 of the first embodiment only in that a second wick structure 33 is generally cuboid. A top surface of the second wick structure 33 is snugly attached to an inner surface of the top plate 111 of the casing 11. In the illustrated embodiment, the second wick structure 33 is located approximately at a middle of the inner surface of the top plate 111. A middle of a bottom surface of the second wick structure 33 contacts a top surface of a first wick structure 32.

Figure 11:
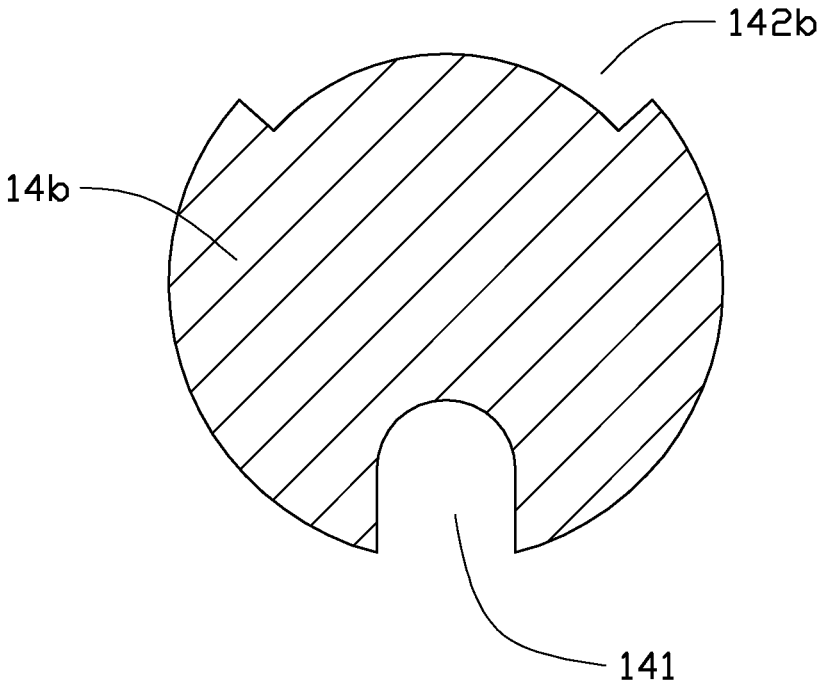
FIG. 11 is a transverse cross section of a cylindrical mandrel used for manufacturing the heat pipe of FIG. 10 according to an exemplary method.
Figure 12:
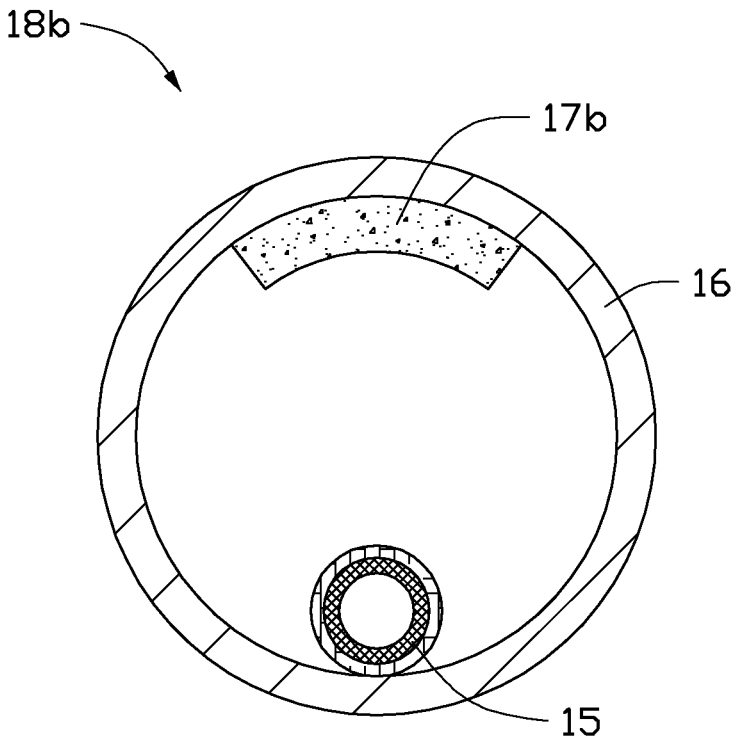
FIG. 12 is a transverse cross section of a semi-finished heat pipe manufactured according to the method of FIG. 11, showing a semi-finished first wick structure and a semi-finished second wick structure received in the cylindrical tube of FIG. 4.

Referring to FIGS. 11 and 12, aspects of an exemplary method for manufacturing the heat pipe 30 are illustrated. This method differs from the method summarized and illustrated in FIGS. 3 to 6 only in that a notch 141*b* of a mandrel 14*b* defines a generally rainbow-shaped cross section. A corresponding second wick structure 71*b* in a circular heat pipe 18*b* also has a generally rainbow-shaped cross section. A second wick structure preform 17*b*, when flattened, forms the cuboid second wick structure 33.

Figure 13:
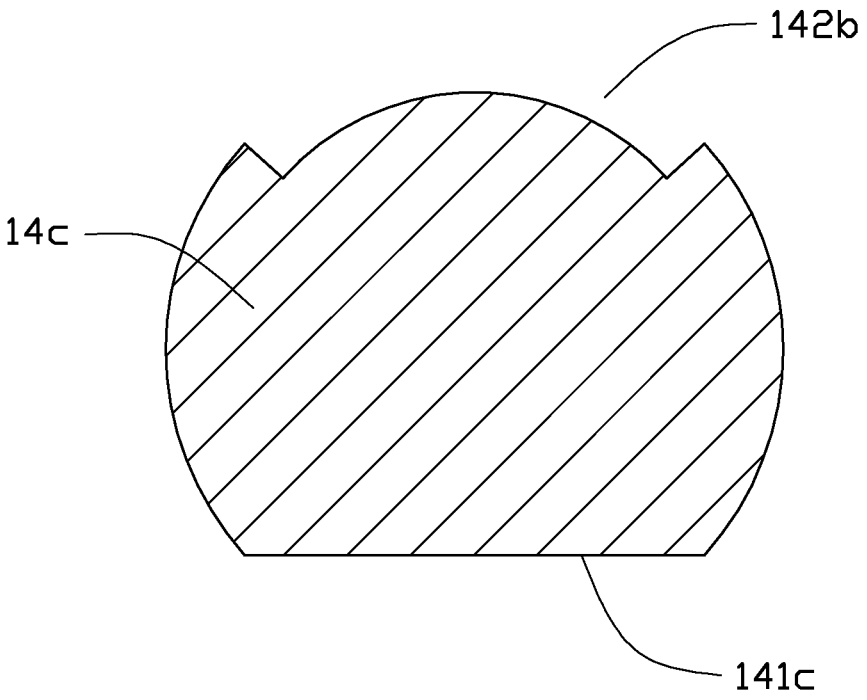
FIG. 13 is similar to FIG. 11, but shows a transverse cross section of a cylindrical mandrel used for manufacturing the heat pipe of FIG. 10 according to another exemplary method.
Figure 14:
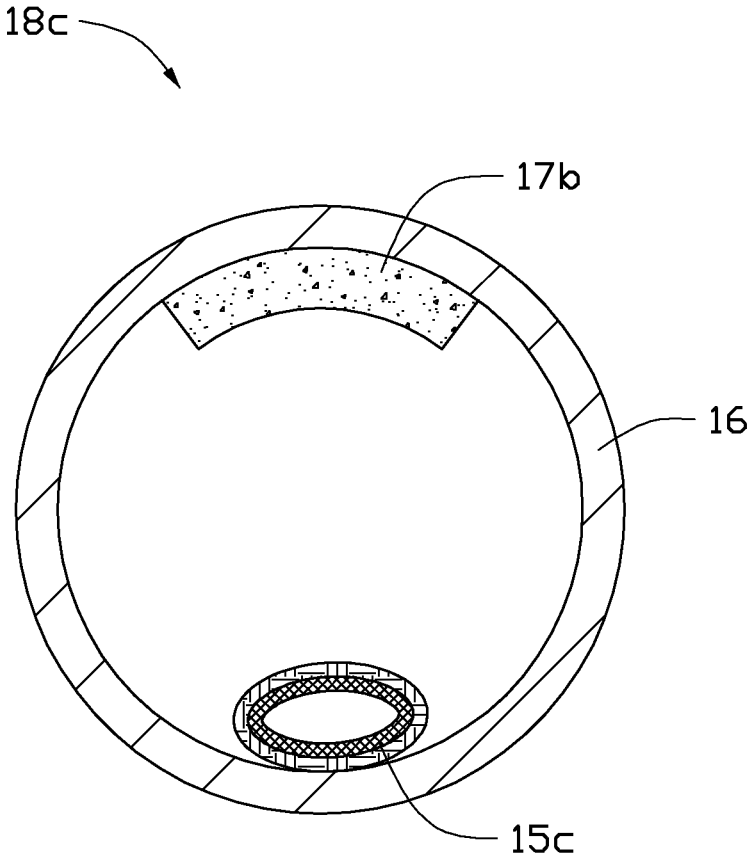
FIG. 14 is similar to FIG. 12, but shows a transverse cross section of a semi-finished heat pipe manufactured according to the method of FIG. 13, showing a semi-finished first wick structure and a semi-finished second wick structure received in the cylindrical tube of FIG. 4.

Referring to FIGS. 13 and 14, aspects of another exemplary method for manufacturing the heat pipe 30 are illustrated. This method differs from the method illustrated in FIGS. 11 and 12 only in that a notch 141*c* of a mandrel 14*c* is planar. A first wick structure preform 15*c* is hollow and cylindrical, and has an elliptic cross section. The mandrel 14*c* is inserted in the tube 16, and the first wick structure preform 15*c* is then inserted into the notch 141*c* of the mandrel 14*c* within the tube 16. After that, a straight circular heat pipe 18*c* is formed.

Figure 15:
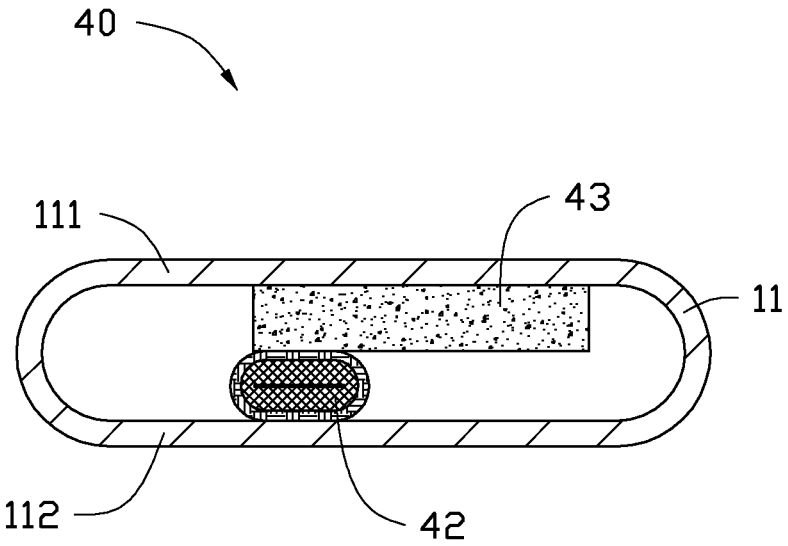
FIG. 15 is similar to FIG. 2, but shows a transverse cross section of a heat pipe according to a fourth embodiment of the disclosure.

Referring to FIG. 15, a heat pipe 40 in accordance with a fourth embodiment of the disclosure is shown. The heat pipe 40 differs from the heat pipe 30 of the third embodiment only in that a first wick structure 42 is located asymmetrically with respect to a second wick structure 43. In the illustrated embodiment, the second wick structure 43 is located approximately at a middle of the inner surface of the top plate 111 of the casing 11, but closer to the right side plate 114 of the casing 11 than the left side plate 113 of the casing 11. The first wick structure 42 is disposed in a middle of the casing 11 but closer to the left side plate 113 than the right side plate 114. A left side of the bottom surface of the second wick structure 43 not in contact with the top plate 111 of the casing 11 is snugly attached to the top surface of the first wick structure 42. Alternatively, the first wick structure 42 can be disposed approximately at the middle of the top plate 111 of the casing 11, but closer to the left side plate 113 than the right side plate 114. In such case, a right side of the bottom surface of the second wick structure 43 not in contact with the top plate 111 of the casing 11 is snugly attached to the top surface of the first wick structure 42.

During manufacture of the heat pipe 40, the first wick structure 15 obliquely faces the second wick structure preform 17*b*, in a manner similar to that illustrated in FIGS. 12 and 14. Then the circular heat pipe 18*b* is flattened. Alternatively, the first wick structure 15*c* obliquely faces the second wick structure preform 17*b*, in a manner similar to that illustrated in FIGS. 12 and 14. Then the circular heat pipe 18*c* is flattened.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat heat pipe comprising:

a hollow, flattened casing, comprising a top plate and a bottom plate opposite to the top plate; and a first wick structure and a second wick structure received in the casing, the first wick structure comprising a plurality of woven wires, the second wick structure made of sintered metal powder, the first and second wick structures disposed at inner sides of the bottom and top plates of the casing, respectively, the first and second wick structures obliquely contacting each other, the casing defining two vapor channels at opposite lateral sides of the combined first and second wick structures, respectively.

2. The flat heat pipe of claim 1, wherein one side of the first wick structure is attached to the bottom plate, one side of the second wick structure is attached to the top plate, and another side of the first wick structure not in contact with the bottom plate is attached to another side of the second wick structure not in contact with the top plate.

3. The flat heat pipe of claim 1, wherein the first wick structure is aligned with the second wick structure, and the second wick structure is attached to a middle of the first wick structure or a middle of the second wick structure is attached to the first wick structure.

4. The flat heat pipe of claim 3, wherein the second wick structure is attached to a middle of the first wick structure, the second wick structure tapers from one side thereof farthest away from the first wick structure toward another side thereof in contact with the first wick structure, and the side of the second wick structure in contact with the first wick structure forms a rounded ridge attached to the middle of the first wick structure.

5. The flat heat pipe of claim 3, wherein the middle of the second wick structure is attached to the first wick structure, and the second wick structure is generally cuboid.

6. The flat heat pipe of claim 1, wherein the first wick structure obliquely faces the second wick structure, and the second wick structure is attached to one side of the first wick structure or one side of the second wick structure is attached to the first wick structure.

7. The flat heat pipe of claim 6, wherein the second wick structure is attached to one side of the first wick structure, and the second wick structure tapers from one side thereof farthest away from the first wick structure toward another side thereof in contact with the first wick structure.

8. The flat heat pipe of claim 6, wherein one side of the second wick structure is attached to the first wick structure, and the second wick structure is generally cuboid.

9. The flat heat pipe of claim 1, wherein the second wick structure is substantially triangular prism-shaped or cuboid, and a side of the second wick structure not in contact with the casing is attached to the first wick structure.

10. The flat heat pipe of claim 1, wherein the first wick structure is a press formed, solid, flattened structure.

11. A flat heat pipe comprising:

a hollow, flattened casing, comprising a top plate and a bottom plate opposite to the top plate; and a first wick structure and a second wick structure attached to inner sides of the bottom and top plates of the casing, respectively, the first wick structure comprising a plurality of woven wires, the second wick structure made of sintered metal powder, the first and second wick structures obliquely contacting each other, the casing defining two separate vapor channels at opposite lateral sides of the combined first and second wick structures, respectively.

* * * * *